US007549950B1

(12) United States Patent
Lundquist et al.

(10) Patent No.: US 7,549,950 B1
(45) Date of Patent: Jun. 23, 2009

(54) WEIGHT BAR SLIDE ASSEMBLY

(75) Inventors: Randal L. Lundquist, Mansfield, OH (US); Alan W. Gore, Powell, OH (US)

(73) Assignee: Recreation Supply, Inc., Sunbury, OH (US)

( * ) Notice: Subject to any disclaimer, the term of this patent is extended or adjusted under 35 U.S.C. 154(b) by 0 days.

(21) Appl. No.: 11/832,633

(22) Filed: Aug. 1, 2007

(51) Int. Cl.
*A63B 21/062* (2006.01)

(52) U.S. Cl. ..... 482/101; 482/104; 482/106; 482/107; 482/108; 601/25; 601/112

(58) Field of Classification Search ..... 482/101, 482/104, 106–108; 601/112, 25
See application file for complete search history.

(56) References Cited

U.S. PATENT DOCUMENTS 4,304,402 A * 12/1981 Ripp ..... 482/125
4,396,191 A * 8/1983 Metler ..... 482/104
4,527,797 A * 7/1985 Slade et al. ..... 482/101
4,641,837 A * 2/1987 Ruth ..... 482/104
4,836,535 A * 6/1989 Pearson ..... 482/101
4,907,798 A * 3/1990 Burchatz ..... 482/99
4,934,693 A * 6/1990 Santoro ..... 482/98
5,050,868 A * 9/1991 Pearson ..... 482/94
5,542,507 A * 8/1996 Warchocki et al. ..... 188/290
5,569,133 A * 10/1996 Vittone ..... 482/98
5,570,957 A * 11/1996 Kuly et al. ..... 384/42
5,628,713 A * 5/1997 Wilkinson ..... 482/74
5,667,460 A * 9/1997 Smith ..... 482/8
5,668,424 A * 9/1997 Lamb ..... 310/103
5,669,859 A * 9/1997 Liggett et al. ..... 482/94
6,231,486 B1 * 5/2001 Lee ..... 482/101
D444,827 S * 7/2001 Mobley ..... D21/694
6,299,568 B1 * 10/2001 Prok ..... 482/104
6,605,023 B1 * 8/2003 Mobley ..... 482/142
6,685,601 B1 * 2/2004 Knapp ..... 482/104
6,733,424 B2 * 5/2004 Krull ..... 482/98
6,905,446 B2 * 6/2005 Greenland ..... 482/100
6,926,649 B2 * 8/2005 Slawinski ..... 482/104
D512,471 S * 12/2005 Panatta ..... D21/673
7,063,649 B2 * 6/2006 Szultka et al. ..... 482/99
7,077,791 B2 * 7/2006 Krull ..... 482/108
7,094,185 B2 * 8/2006 Greenland ..... 482/100
7,131,937 B2 * 11/2006 Skilken et al. ..... 482/93
7,141,009 B2 * 11/2006 Shifferaw ..... 482/135
7,223,215 B2 * 5/2007 Bastyr ..... 482/115
7,285,077 B1 * 10/2007 Marx ..... 482/104
7,338,416 B2 * 3/2008 Smith ..... 482/104

(Continued)

*Primary Examiner*—Loan H Thanh
*Assistant Examiner*—Robert F Long
(74) *Attorney, Agent, or Firm*—Standley Law Group LLP

(57) ABSTRACT

A weight bar slide assembly, for use with weightlifting equipment having vertical guide bars that provide for an accurate simulation of the free weight lifting motion. The weight bar slide assembly has a weight bar sleeve to rotatably receive a weight bar. A rod is attached to the weight bar sleeve and extends outwardly therefrom. A rod sleeve rotatably receives the rod. The rod may rotate along its longitudinal axis inside the rod sleeve. The rod sleeve is attached to a vertical guide. The vertical guide is movably mounted to a vertical guide bar. The longitudinal axis rotation of the rod within the rod sleeve allows for the freedom of motion found in the free weight lifting motion. The weight bar slide assemblies attached to opposing ends of the weight bar may move linearly along the vertical guide bar independently of each other.

16 Claims, 8 Drawing Sheets

U.S. PATENT DOCUMENTS

2001/0018387 A1* 8/2001 Webber ..... 482/142
2003/0027695 A1* 2/2003 Lee ..... 482/99
2003/0060337 A1* 3/2003 Yu ..... 482/57
2006/0035765 A1* 2/2006 Smith ..... 482/94
2006/0089239 A1* 4/2006 Davies, III ..... 482/91
2006/0252609 A1* 11/2006 Abelbeck ..... 482/92
2006/0252612 A1* 11/2006 Melcer ..... 482/94
2007/0155604 A1* 7/2007 Hockemeyer ..... 482/142
2007/0161467 A1* 7/2007 Lee ..... 482/57
2007/0203002 A1* 8/2007 Webber ..... 482/104
2008/0114362 A1* 5/2008 Justis et al. ..... 606/72

* cited by examiner

WEIGHT BAR SLIDE ASSEMBLY

BACKGROUND AND SUMMARY OF THE INVENTION

The present invention relates generally to exercise equipment and, more particularly to a weight lifting device having a weight bar slide assembly.

Many weightlifters perform a variety of exercises to build and develop muscle. These exercises can be performed through the use of free weights or the use of weightlifting machines. While both free weights and weightlifting machines provide a means to develop and build muscle, many weightlifters prefer the natural motion afforded by the use of free weights. The ability to move naturally allows the weightlifter a greater degree of variety in their exercise routine and the ability to isolate specific muscles. Although a variety of weightlifting machines have been developed to imitate the freedom of motion found in the use of free weights, the weightlifter's movements must still conform to the limitations of the weightlifting machine.

Even though the use of free weights in weight training allows a natural lifting motion, many weightlifters prefer to use weightlifting machines for the safety features found in weightlifting machines. Weightlifting machines may provide safety by allowing weightlifters to stop the exercise motion at any time should the weight prove to be uncontrollable. Traditionally, to provide this level of safety in the use of free weights a spotter is used. A spotter provides assistance to the weightlifter should the weight prove to be too much or if the weightlifters lose balance. The need for a spotter has limited the use of free weights to situations where other individuals are present and willing to participate as a spotter.

Many innovations in the field of weightlifting equipment have attempted to balance the needs of weightlifters by attempting to provide the freedom of motion found in the use of free weights and the safety found in the use of weightlifting machines. One such device that embodies the balance between freedom of motion and the safety concerns is know as a power rack, power cage, or "Smith Machine." Such a device allows a weightlifter to use free weights without the need for a spotter. This is accomplished through the connection of a pair of side frames to a back frame. Vertical guide bars carry a weight bar slide assembly which can slide along the length of the vertical guide bar. A weight bar runs laterally and is carried by the weight bar slide assembly. Free weights can be added to the weight bar. While standing in the device a weightlifter can lift the weigh bar up and down within the device. To eliminate the need for a spotter, the device provides a method of racking the weight bar during any point of the exercise motion.

Further innovations increased the freedom of motion available to the weightlifter. Devices such as the "Max Rack" and similar devices have added a horizontal guide bar to the vertical guide bars found in power cages or "Smith Machines" allowing the weightlifter to move the weight bar both horizontally and vertically within the device.

While the safety feature described above is comparable to the safety features found on weightlifting machines, the weight bar remains parallel to the floor. An exemplary embodiment of the present invention provides a weight bar slide assembly that allows opposing ends of the weight bar to be at differing vertical positions throughout the motion of the lift thereby requiring the weightlifter to maintain balance and utilize stabilizing muscles.

In one example, a weight bar slide assembly for use on vertical guides includes a weight bar, rod, rod sleeve, and a vertical guide bar. The weight bar sleeve is rotatably attached to a weight bar. The weight bar sleeve contains a means for allowing rotational motion of the weight bar. The means for allowing weight bar rotational motion may include various types of bearings, lubricants, lubricants used in connection with bushings, and various arrangements of rollers. The rotational motion allows for a natural lifting motion and provides the ability to use safety systems that require a twisting motion to rack the weight.

In an exemplary embodiment, one end of a rod is attached to the weight bar sleeve and extends therefrom. The rod is rotatably received by a rod sleeve. The rod sleeve provides a means for rotational motion of the rod. The means of rotation may include various types of bearings, lubricants, lubricant used in conjunction with bushings, and various types of rollers. The orientation of the rod and rod sleeve is such that the rotational motion of the rod within the rod sleeve allows the weight bar slide assembly to move upward and downward independent of the weight bar slide assembly fixed to the opposing end of the weight bar. In one embodiment of the present invention the rod sleeve is enclosed to prevent foreign matter from entering the sleeve.

The rod sleeve is coupled to a vertical guide in an exemplary embodiment. The vertical guide is movably mounted on a vertical guide bar. The vertical guide moves linearly along the vertical guide bar. This linear motion may be accomplished through the use of bearings, lubricants, lubricant used in connection with bushings, or various types of rollers.

In other embodiments of the present invention a bore is made through the rod sleeve traversing the rod and exiting through the rod sleeve. A pin having an angle at one end is passed through the bore. The angled portion of the pin serves to hold the pin in the bore preventing the rotational motion of the rod within the rod sleeve. In other embodiments the pin angled at one end is replaced by a spring-loaded pull pin. When in the locked position the spring-loaded pull pin prevents the rotational motion of the rod within the rod sleeve. It is to be understood that the rod rotational lockout could include a pin, a pin having an angled portion at one end, a pull pin, a push pin, a bolt or any other removable means of preventing rotational motion obvious to one skilled in the art. In addition, the depth of the bore necessary for the various means of rotational lockout would be obvious to ones skilled in the art.

In other embodiments of the present invention, a channel is used in the rod sleeve to limit the degree of rotational motion. The channel is cut out of the rod sleeve, allowing the rod contained therein to be exposed. A bolt is passed through the channel in the rod sleeve and attached to the rod. As the rod rotates within the rod sleeve the bolt slides within the channel. When the bolt reaches the one of the channel's ends it prevents further rotational motion in that direction. The degree of rotational motion allowed is determined by the length of channel. In other embodiments of the invention the bolt could be replaced with a pin or other device capable of passing through the channel and connecting to the rod limiting rotational motion.

In another embodiment of the present invention the weight bar slide assembly for use on vertical guide bars includes a weight bar sleeve and a vertical guide. A weight bar sleeve is rotatably attached to a weight bar. Along with rotational motion of the weight bar, the rotational means also allows misalignment of the weight bar. Various types of bearings such as spherical bearings allow for misalignment while still providing rotational motion. The weight bar sleeve is attached to a vertical guide. The vertical guide is movable attached to vertical guide bar. The vertical guide moves upwardly or downwardly along the vertical guide bar. This linear motion may be accomplished through the use of bearings, lubricants, lubricant used in connection with bushings, or various types of rollers.

The ability to allow misalignment of the weight bar permits the weight bar slide assemblies to move vertically independent of one another. The independent motion of the opposing ends of the weight bar more closely simulates a true free weight lifting motion thereby requiring the weightlifter to maintain balance and develop stabilizing muscles. An example of the present invention can be used on weightlifting equipment having vertical guide bars. One skilled in the art would also recognize that an exemplary embodiment of the present invention can be used with a variety of weight racking systems.

BRIEF DESCRIPTION OF THE DRAWINGS

In order that the present invention may be more clearly understood, embodiments hereof will now be described in detail by way of example, with reference to the accompanying drawings, in which.

DETAILED DESCRIPTION OF THE EXEMPLARY EMBODIMENT(S)

Figure 1:
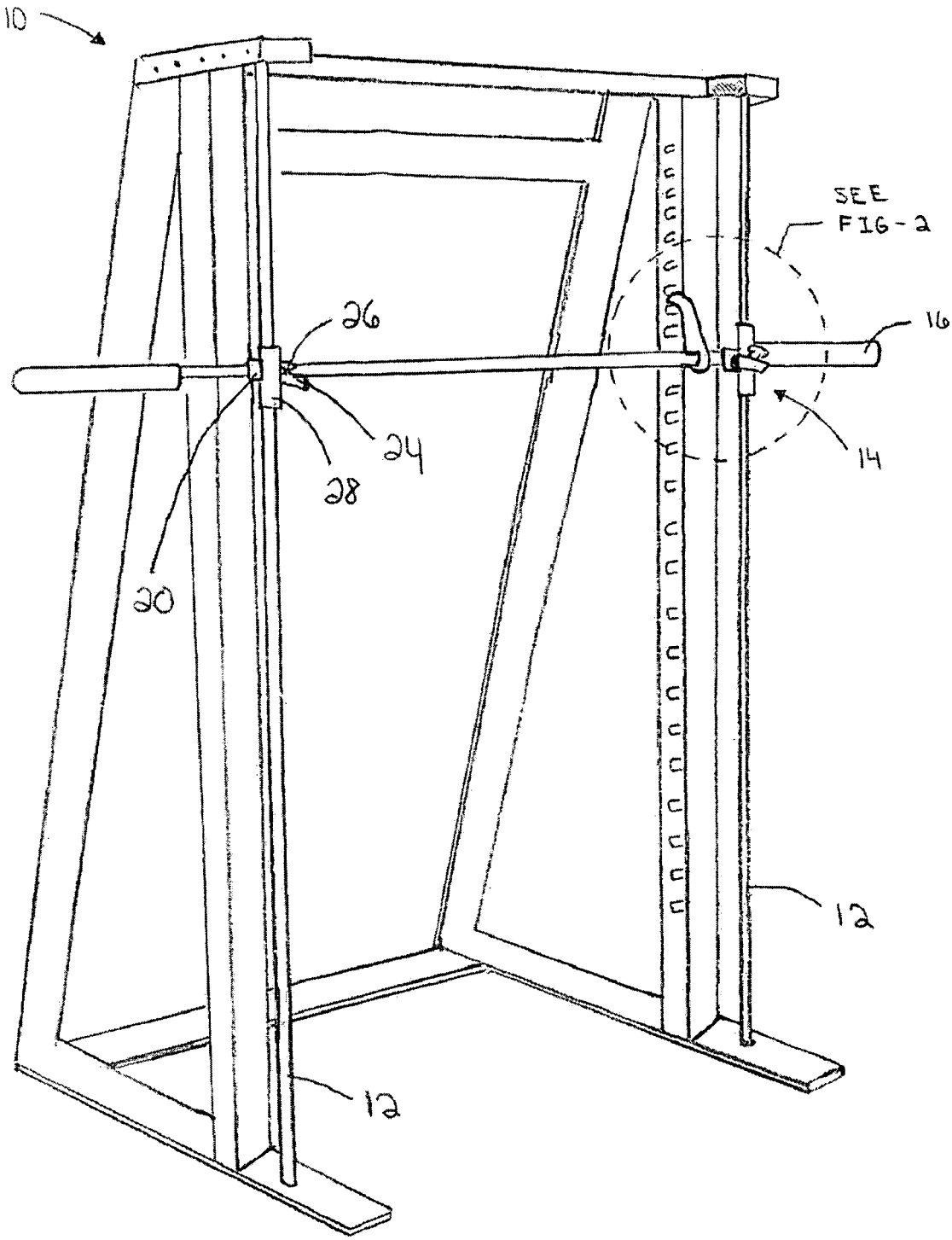
FIG. 1 is a perspective view of a weightlifting apparatus, including an example of a weight bar slide assembly of the present invention.

Referring now to the example of FIG. 1, a weight lifting power cage 10 is shown having a pair of vertical guide bars 12. Weight bar slide assemblies 14 are movably attached to the vertical guide bars 12. A weight bar 16 is retained by the weight bar slide assembly 14. The weight lifting power cage 10 is an example of a type of weight lifting device that may benefit from the present invention. The weight bar slide assemblies 14 of the present invention can be used with weightlifting equipment having vertical guide bars, including, but not limited to "Smith Machines", power lifting cages, or power racks.

Figure 2:
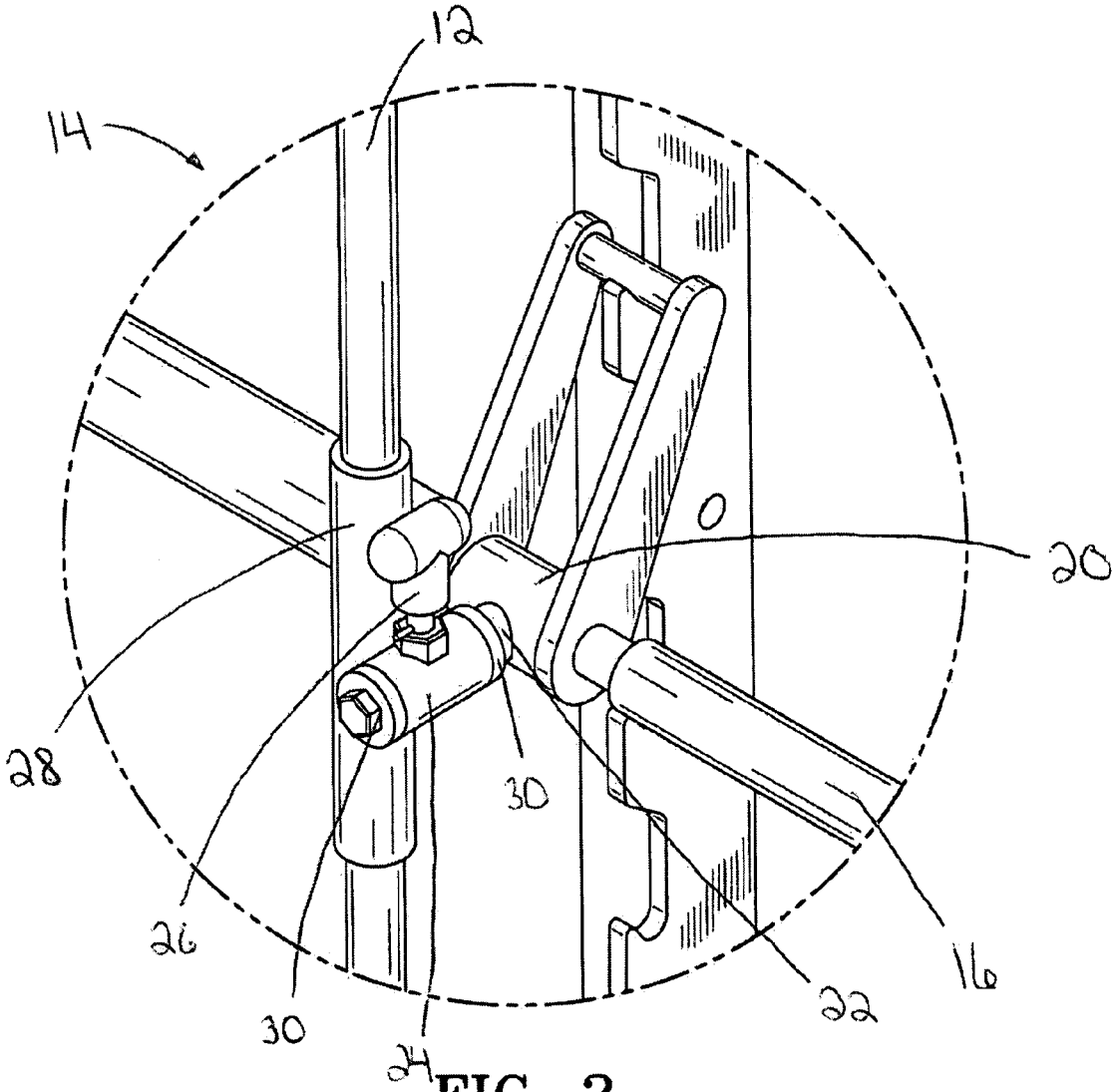
FIG. 2 is an enlarged view of the weight bar slide assembly circled in FIG. 1.

Referring to FIG. 2, the weight bar slide assembly 14 has a weight bar sleeve 20. The weight bar sleeve 20 having a passage disposed therein for rotatably receiving a weight bar 16. A rod 22 is fixed to the weight bar sleeve 20 and extends outwardly therefrom. A rod sleeve 24 rotatably receives the rod 22 and allows rotation of the rod within the rod sleeve in both directions. A locking pull pin assembly 26 is mounted to the rod sleeve 24. When the locking pull pin assembly 26 is in the locked position, the pin portion of the locking pull pin assembly 26 is engaged with the rod 22 preventing rotational motion. When the locking pull pin assembly 26 is in the unlocked position the rod 22 may rotate freely inside the rod sleeve 24.

The rod sleeve 24 is attached to a vertical guide 28. The vertical guide 28 movably receives the vertical guide bar 12, allowing the weight bar slide assembly 14 to move linearly over the length of the vertical guide bar 12. A bolt and washer assembly 30 provides a means of securely fastening the rod 22 inside the rod sleeve 24. In addition, the bolt and washer assembly 30 provide a seal to the rod sleeve 24 preventing foreign matter from affecting the rotational motion of the rod 22.

Figure 3:
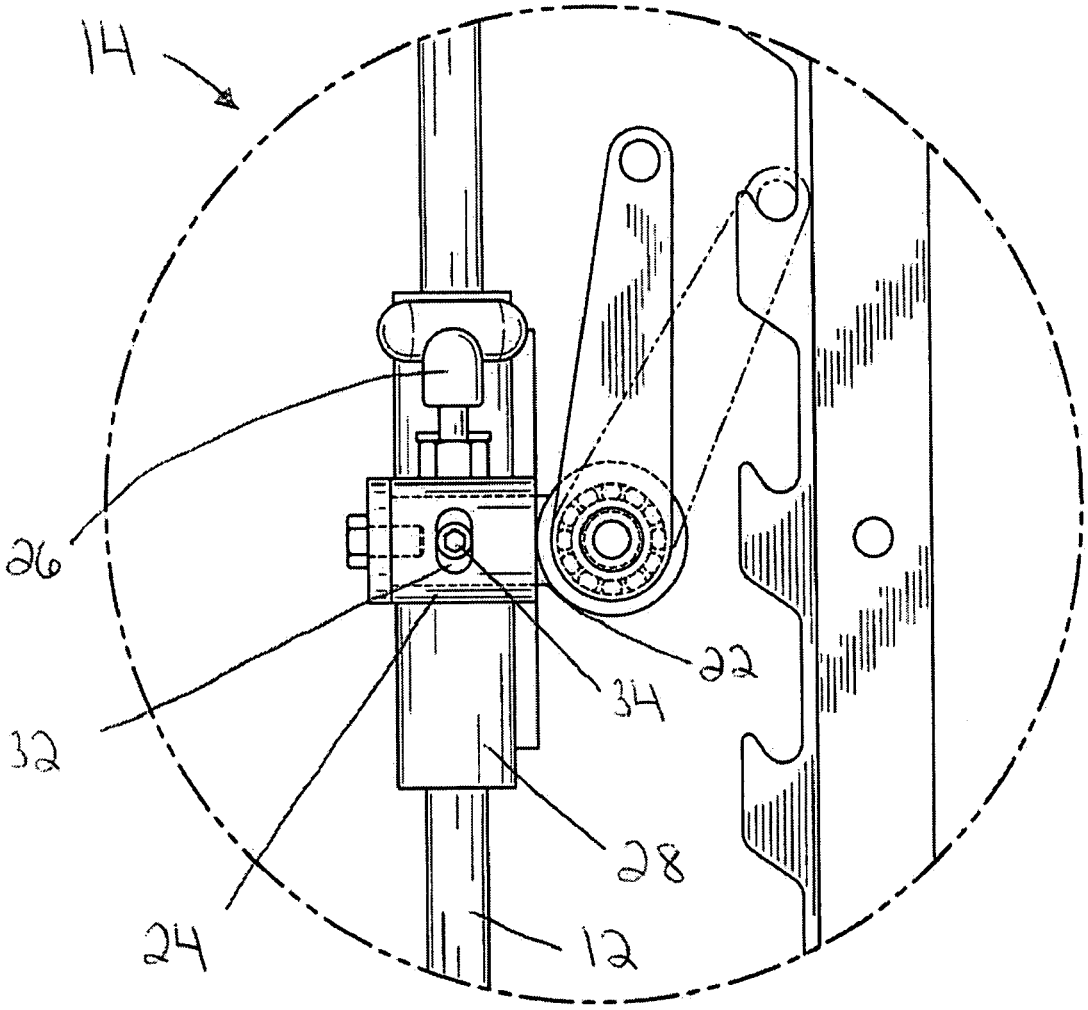
FIG. 3 is an enlarged side elevation view of the weight bar slide assembly of FIG. 2.

FIG. 3 shows another exemplary embodiment of the weight bar slide assembly 14. In this embodiment the rod sleeve 24 has a channel cut out 32. The channel cut out 32 runs vertically on the rod sleeve 24 and is sized to allow a rotation limiting means 34 to pass through. The rotation limiting means 34 passes through the channel cut out 32 and is secured to the rod 22. As the rod 22 rotates inside the rod sleeve 24, the rotation limiting means 34 travels upwards or downwards in the channel cut out 32. When the rotation limiting means 34 reaches the either end of the channel cut out 32 the rod 22 is prevented from further rotational motion in that direction. The rotation limiting means may be removably connected to the rod 22. In other embodiments, the rotation limiting means 34 may be permanently attached to the rod 22.

Figure 4B:
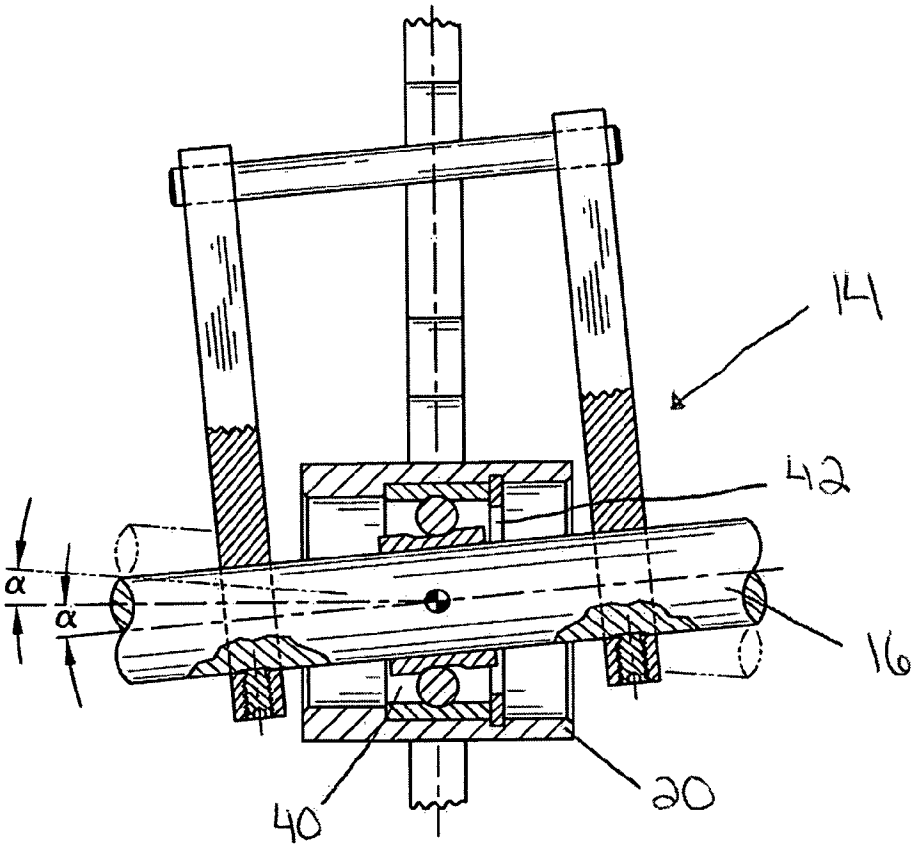
FIG. 4B is across section view of an alternate embodiment of the weight bar assembly in an angled position.
Figure 4A:
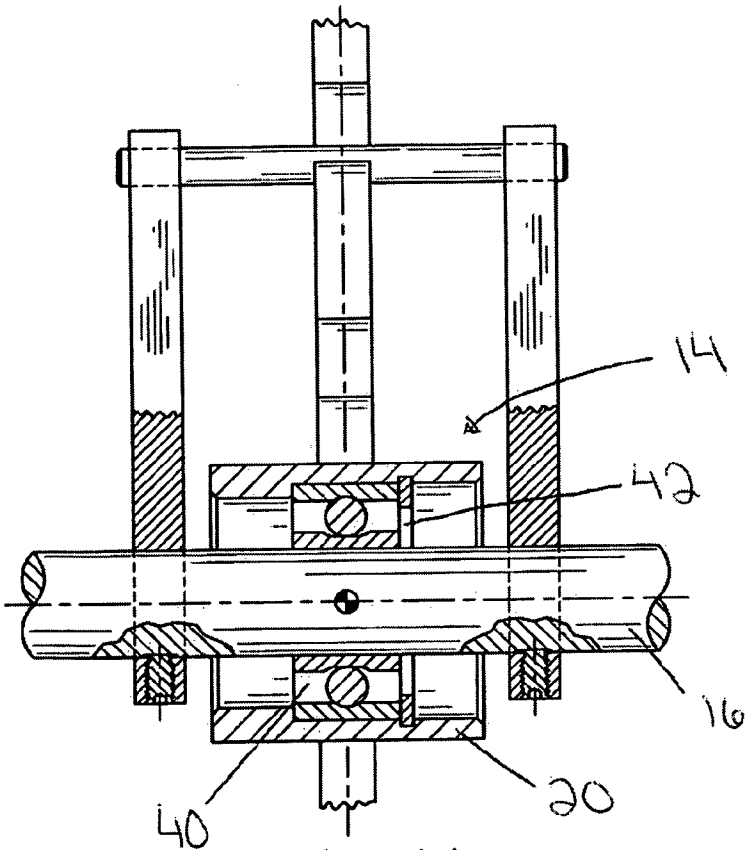
FIG. 4A is a cross section view of an alternate embodiment of the weight bar slide assembly in the horizontal position.

FIG. 4A and FIG. 4B shows an alternate embodiment of the weight bar slide assembly 14. The weight bar slide assembly 14 has a weight bar sleeve 20 rotatably receiving a weight bar 16. The weight bar sleeve contains a bearing 40 allowing for rotational motion and the ability for the weight bar 16 to misalign with the bearing 40. The bearing 40 may be held in place by a snap ring 42 or other similar device. This misalignment allows each of the weight bar slide assembly 14, located at opposing ends of the weight bar 16, to linearly along the vertical guide bars independently. The degree of misalignment $\alpha$ is determined by the bearing 40. The weight sleeve 20 is attached to the vertical guide 28 (shown in FIG. 2).

Figure 5:
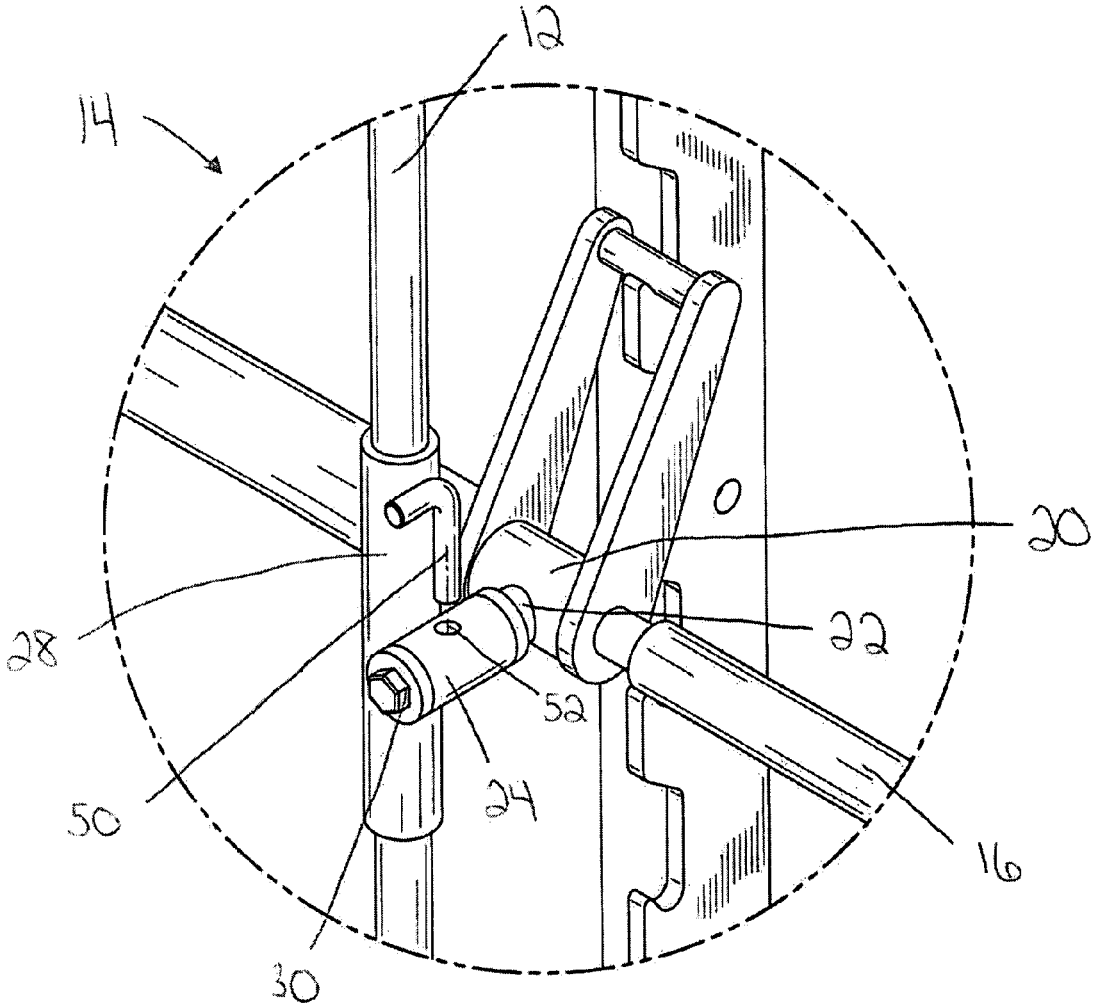
FIG. 5 is an enlarged view of one exemplary embodiment of the weight bar slide assembly.

FIG. 5 shows an alternate embodiment of the weight bar slide assembly. In this embodiment, the spring-loaded pull pin 26 is replaced by a pin 50 angled at an end. A bore 52 is made through the rod sleeve 24, passing through the rod 22 and exiting the rod sleeve 24. The pin 50 is passed through the bore 52 and prevents the rotational motion of the rod 22 within the rod sleeve 24.

Figure 6:
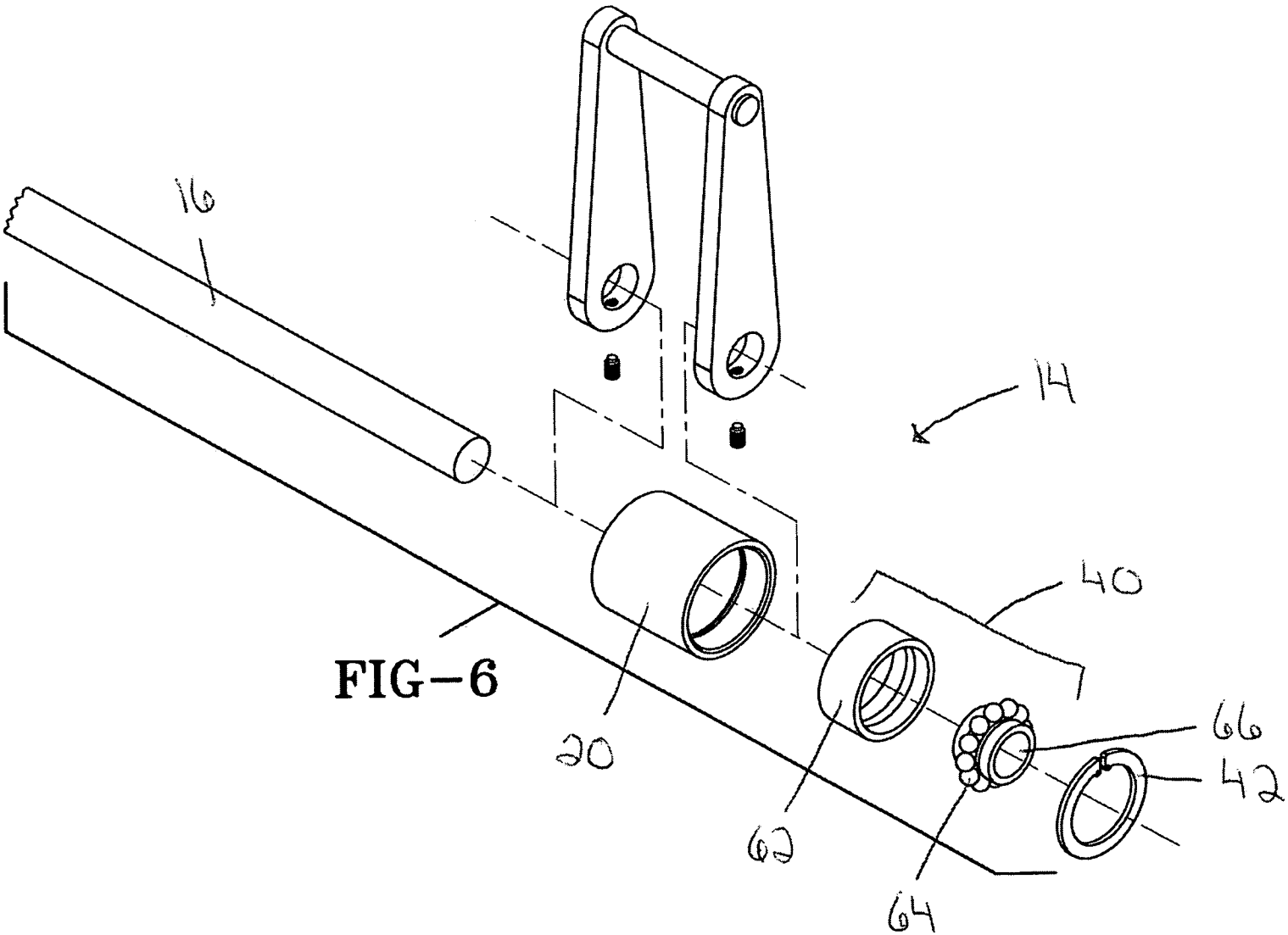
FIG. 6 is an exploded view of one exemplary embodiment of the weight bar slide assembly.

FIG. 6 shows an exploded view of an alternate embodiment of the weight slide bar assembly 14. A weight bar sleeve 20 is rotatably attached to a weight bar 16. The weight bar sleeve 20 is fitted with a bearing 40. The bearing 40 is made of an outer race 62, spherical balls 64 and an inner race 66. The bearing 40 is held in place by a snap ring 68. The weight bar 16 is held by the inner race 66. The bearing 40 is designed to allow the inner race 66 to pivot on the spherical balls 64. This pivoting allows the weight bar 16 to misalign with the vertical plane of the bearing 40.

Figure 7:
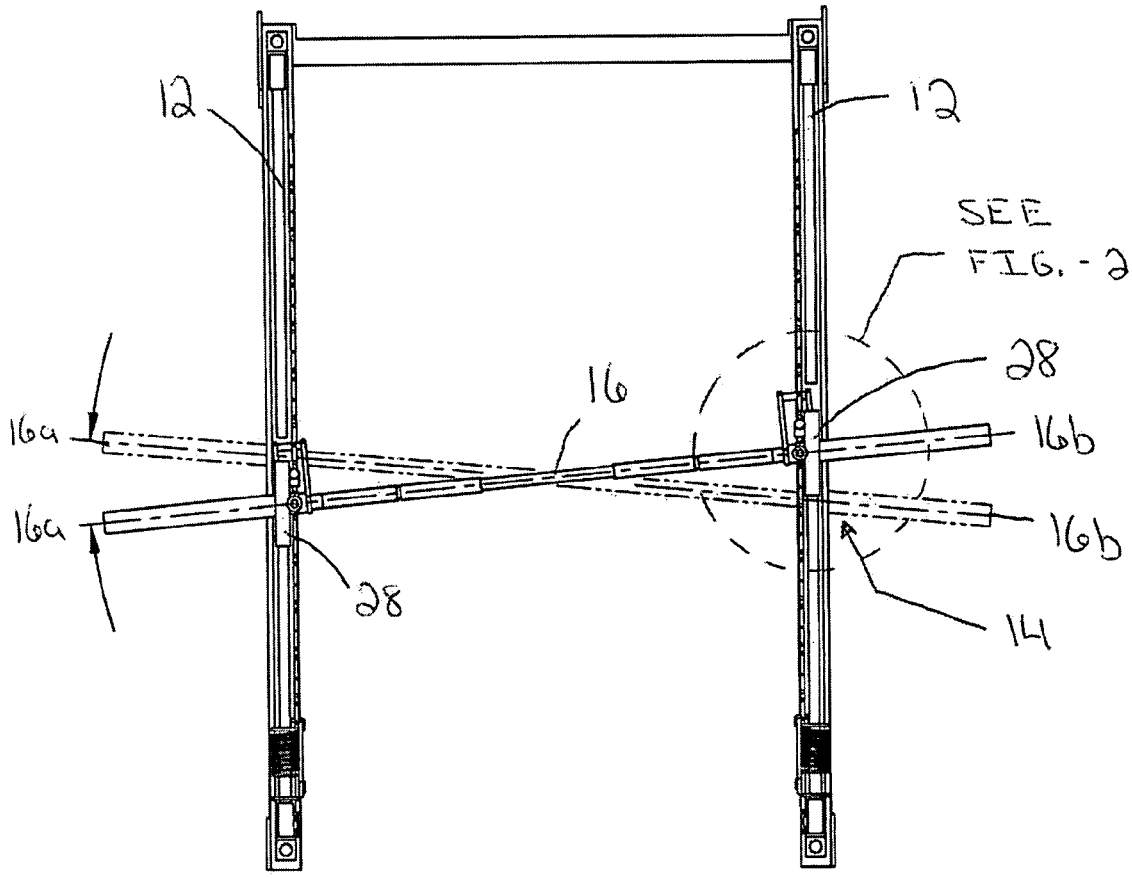
FIG. 7 is an elevation view of an embodiment of the weight bar slide assembly.

FIG. 7 provides a visual representation of the freedom of motion provided by an exemplary embodiment of the present invention. The rotation of the rod 22 (shown in FIG. 2) inside the rod sleeve 24 (shown in FIG. 2) allows the vertical guides 28 attached to the rod sleeves 24 (shown in FIG. 2) to move linearly along the vertical guide bars 12. A weight bar slide assembly 14 located at either end of the weight bar 16 allows independent linear motion. As shown in FIG. 7 this independent motion allows a first end of the weight bar 16*a* to be at a differing vertical position along the vertical guide bar 12 than a second end of the weight bar 16*b*. The independent motion allows the first end of the weight bar 16*a* or the second end of the weight bar 16*b*, to be located at a higher vertical position.

Figure 8:
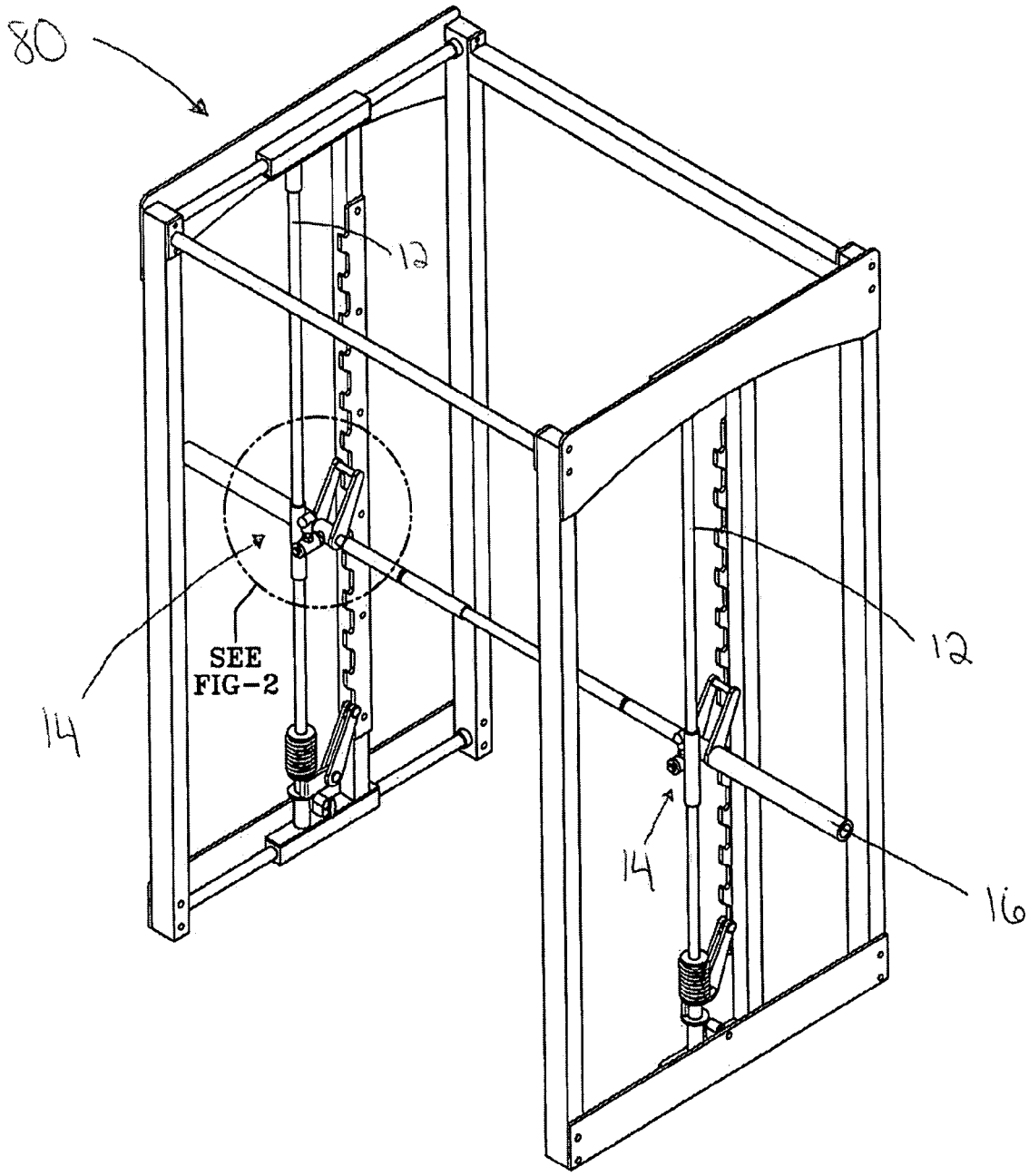
FIG. 8 is another perspective view of an embodiment of the invention in use with a "Max Rack" machine

Referring now to FIG. 8, a "Max Rack" type device 80 is shown having a pair of vertical guide bars 12. Weight bar slide assemblies 14 are movably attached to the vertical guide bars 12. A weight bar 16 is retained by the weight bar slide assembly 14. The "Max Rack" type device 80 is an example of a type of weight lifting device that may benefit from the present invention.

Other advantages, which are inherent to the structure, are obvious to one skilled in the art. The exemplary embodiments are described herein illustratively and are not meant to limit the scope of the invention as claimed. Variations of the foregoing embodiments will be evident to a person of ordinary skill and are intended by the inventor to be encompassed by the following claims.

What is claimed is:

1. A weight lifting exercise device comprising:

a weight bar;

a vertical guide bar;

a weight bar slide assembly comprising: a weight bar sleeve having a passage disposed therein for rotatably receiving said weight bar; a rod fixedly attached to said weight bar sleeve and extending perpendicularly from said weight bar sleeve, said rod having a longitudinal axis the rod fixedly attached to the weight bar sleeve a vertical guide sleeve movably mounted on said vertical guide bar, the vertical guide sleeve capable of vertical movement along said vertical guide bar; and a rod sleeve fixedly attached to said vertical guide sleeve, said rod sleeve having a passage therein for receiving said rod, said rod being pivotally attached to said rod sleeve and capable of pivotal motion within said passage.

2. The weight lifting exercise device of claim 1, wherein the rod sleeve and rod have a bore running vertically through said rod sleeve and rod.

3. The weight lifting exercise device of claim 1, wherein a means of preventing rotational motion of the rod within the rod sleeve is passed through the bore.

4. The weight lifting exercise device of claim 1, wherein the rod sleeve is enclosed.

5. The weight lifting exercise device of claim 1, wherein the rod sleeve has a channel cut out running vertically exposing the rod within.

6. The weight lifting exercise device of claim 5, wherein a rotation limiter is passed through the channel in the rod sleeve and is fixedly attached to the rod.

7. The weight lifting exercise device of claim 3, where the means for preventing rotational motion of the rod is a pin having an angle at one end.

8. The weight lifting exercise device of claim 3, wherein the means for preventing rotational motion of the rod is a spring-loaded pull pin.

9. The weight lifting exercise device of claim 6, wherein the rotation limiter is a removable threaded bolt.

10. The weight lifting exercise device of claim 1, wherein the longitudinal axis of said rod within said rod sleeve is perpendicular to weight bar sleeve.

11. Weight lifting exercise device comprising: a weight bar;

a vertical guide bar;

a weight bar slide assembly comprising:

a weight bar sleeve having a passage disposed therein for rotatably receiving said weight bar; a rod fixedly attached to said weight bar sleeve and extending perpendicularly from said weight bar sleeve, said rod having a longitudinal axis the rod fixedly attached to the weight bar sleeve a vertical guide sleeve movably mounted on said vertical guide bar, the vertical guide sleeve capable of vertical movement along said vertical guide bar; a rod sleeve fixedly attached to said vertical guide sleeve, said rod sleeve having a passage therein for receiving said rod, said rod being pivotally attached to said rod sleeve and capable of pivotal motion within said passage and a means of preventing rotation of said rod relative to said rod sleeve.

12. The weight lifting exercise device of claim 11, wherein the rod and rod sleeve have a bore passing vertically through said rod and rod sleeve.

13. The weight lifting exercise device of claim 11, wherein the means of preventing rotation of said rod relative to said rod sleeve is a pin having an angle at one end passed through the vertical bore located in the rod and rod sleeve.

14. The weight lifting exercise device of claim 11, wherein the rod sleeve has a channel cut out funning vertically exposing the rod within.

15. The weight lifting exercise device of claim 13, wherein a rotation limiter is passed through the channel in the rod sleeve and is fixedly attached to the rod.

16. The weight lifting exercise device of claim 1, wherein the longitudinal axis of said rod within said rod sleeve is perpendicular to weight bar sleeve.

* * * * *